US010907880B2

(12) United States Patent
Avhale et al.

(10) Patent No.: US 10,907,880 B2
(45) Date of Patent: Feb. 2, 2021

(54) REFRIGERATOR MULLION ASSEMBLY WITH ANTI-CONDENSATION FEATURES

(71) Applicant: WHIRLPOOL CORPORATION, Benton Harbor, MI (US)

(72) Inventors: Amit A. Avhale, St. Joseph, MI (US); Kapil Ayyawar, St. Joseph, MI (US); Rishikesh Vinayak Kulkarni, St. Joseph, MI (US); E C. Pickles, St. Joseph, MI (US); Yan Zhang, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 149 days.

(21) Appl. No.: 16/222,039

(22) Filed: Dec. 17, 2018

(65) Prior Publication Data

US 2020/0191464 A1 Jun. 18, 2020

(51) Int. Cl.
*F25D 21/04* (2006.01)
*F25D 23/02* (2006.01)

(52) U.S. Cl.
CPC ..... *F25D 21/04* (2013.01); *F25D 23/028* (2013.01); *F25D 2201/10* (2013.01); *F25D 2323/021* (2013.01); *F25D 2400/04* (2013.01); *F25D 2700/121* (2013.01)

(58) Field of Classification Search
CPC .. F25D 23/028; F25D 23/025; F25D 2201/10; F25D 2323/021; F25D 2400/06; F25D 2400/04; F25D 2700/121; F25D 2400/02
See application file for complete search history.

(56) References Cited

U.S. PATENT DOCUMENTS

| | | | |
|---|---|---|---|
| 4,260,876 | A | 4/1981 | Hochheiser |
| 4,261,179 | A | 4/1981 | Dageford |
| 5,600,966 | A | 2/1997 | Valence et al. |
| 7,008,032 | B2 | 3/2006 | Chekal et al. |
| 7,207,181 | B2 | 4/2007 | Murray et al. |
| 7,421,847 | B2 | 9/2008 | Murray et al. |
| 8,434,317 | B2 | 5/2013 | Besore |
| 9,506,689 | B2 | 11/2016 | Carbajal et al. |
| 2005/0229614 | A1 | 10/2005 | Ansted |

(Continued)

FOREIGN PATENT DOCUMENTS

| | | | |
|---|---|---|---|
| CN | 101988780 | A | 3/2011 |
| CN | 104006623 | A | 5/2014 |
| WO | 2014139141 | A1 | 9/2014 |

*Primary Examiner* — Ana M Vazquez
(74) *Attorney, Agent, or Firm* — Price Heneveld LLP

(57) ABSTRACT

A refrigerator includes a storage compartment and a mullion assembly pivotally coupled to one of a first door and a second door. The mullion assembly includes a cavity with an insulating member disposed therein. One or more sensor assemblies are coupled to the mullion assembly and configured to collect data sufficient to calculate a dew point temperature of the mullion assembly and an actual temperature of the mullion assembly. A heating element is coupled to the mullion assembly and is selectively activated by a controller based on information provided from the one or more sensor assemblies. The heating element is powered using a modulated power level that is inversely proportionate to the difference in temperature between the mullion assembly and the calculated dew point.

6 Claims, 5 Drawing Sheets

(56) References Cited

U.S. PATENT DOCUMENTS

| | | | | |
|---|---|---|---|---|
| 2014/0216706 | A1 | 8/2014 | Melton et al. | |
| 2015/0015133 | A1 | 1/2015 | Carbajal et al. | |
| 2015/0285551 | A1 | 10/2015 | Aiken et al. | |
| 2016/0178267 | A1 | 6/2016 | Hao et al. | |
| 2016/0290702 | A1 | 10/2016 | Sexton et al. | |
| 2016/0348957 | A1 | 12/2016 | Hitzelberger et al. | |
| 2017/0183471 | A1* | 6/2017 | Kikuchi | B29C 48/92 |

* cited by examiner

REFRIGERATOR MULLION ASSEMBLY WITH ANTI-CONDENSATION FEATURES

BACKGROUND

The present device generally relates to a mullion assembly, and more specifically, to a mullion assembly having anti-condensation features.

SUMMARY

In at least one aspect, a refrigerator includes a storage compartment having an open front portion. First and second doors are operable between open and closed positions with respect to the open front portion of the storage compartment. A mullion assembly is pivotally coupled to one of the first and second doors and operable between retracted and deployed positions. The mullion assembly includes a cavity. An insulating member is positioned within the cavity of the mullion assembly. At least one sensor assembly is coupled to the mullion assembly. A heating element is coupled to the mullion assembly and is selectively activated by a controller based on information provided from the at least one sensor assembly.

In at least another aspect, a method of controlling condensation on a mullion assembly is disclosed, wherein the method includes the steps of: 1) providing a refrigerator with a mullion assembly, wherein the mullion assembly includes one or more sensors and a heating element; 2) collecting data in the form of a temperature value of the mullion assembly, an ambient air temperature value associated with the mullion assembly, and a relative humidity value associated with the mullion assembly using the one or more sensors of the mullion assembly; 3) sending the data to a controller for processing; 4) calculating a dew point temperature value from the data using the controller; 5) comparing the dew point temperature value with the temperature value of the mullion assembly to provide a value differential therebetween using the controller; and 6) selectively powering the heating element in response to the value differential.

In at least another aspect, a method of controlling condensation on a mullion assembly is disclosed, wherein the method includes the steps of: 1) providing a refrigerator with a mullion assembly, wherein the mullion assembly includes one or more sensors and a heating element; 2) collecting data in the form of a temperature value of the mullion assembly, an ambient air temperature value associated with the mullion assembly, and a relative humidity value associated with the mullion assembly using the one or more sensors of the mullion assembly; 3) sending the data to a controller for processing; 4) calculating a dew point temperature value from the data using the controller; 5) comparing the dew point temperature value with the temperature value of the mullion assembly to provide a value differential therebetween using the controller; and 6) selectively powering the heating element at a modulated power level that is inversely proportionate to the value differential from a beginning to an end of a duty cycle.

These and other features, advantages, and objects of the present device will be further understood and appreciated by those skilled in the art upon studying the following specification, claims, and appended drawings.

DETAILED DESCRIPTION OF EMBODIMENTS

Figure 1:
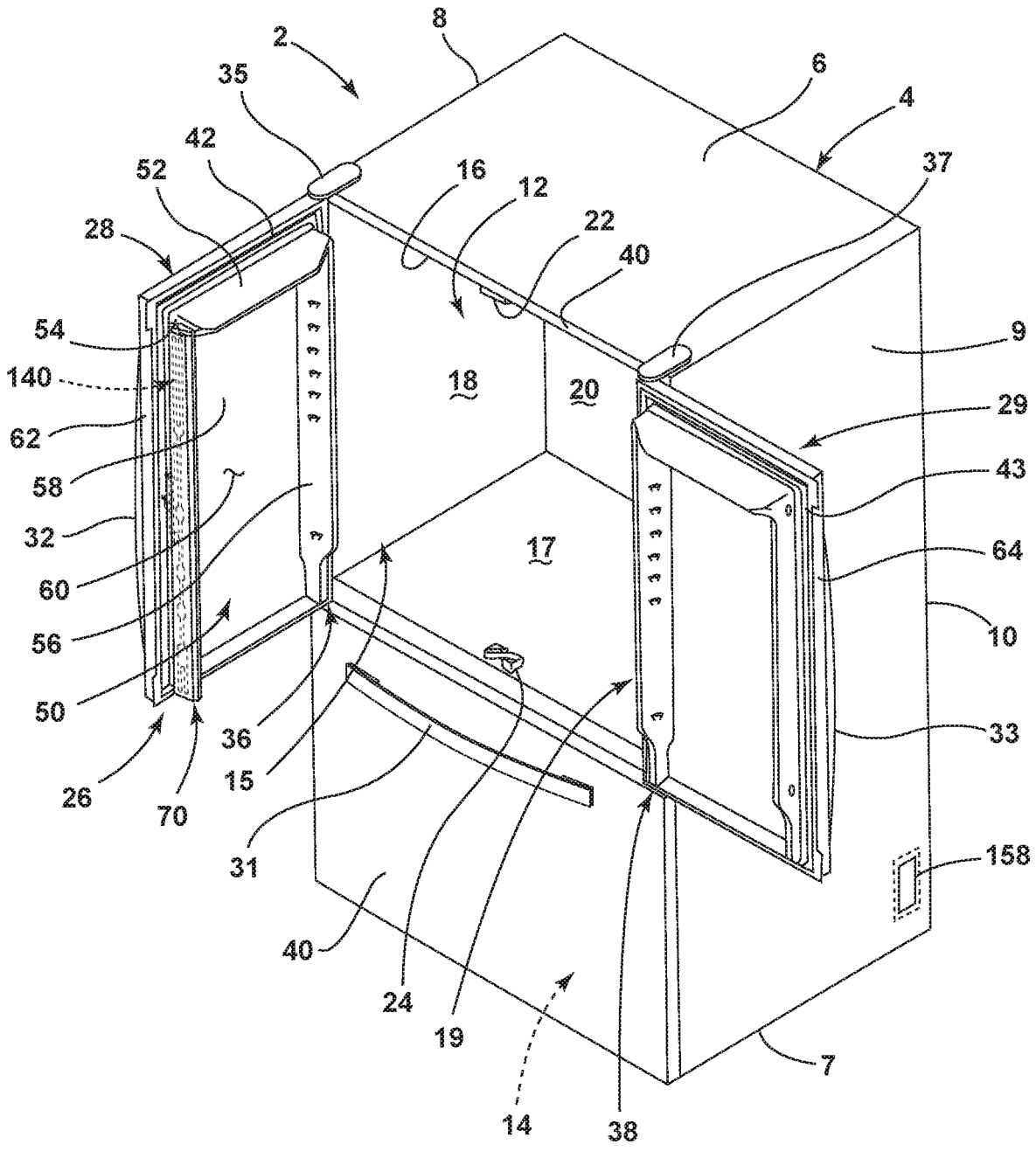
FIG. 1 is a top perspective view of a bottom mount refrigerator having first and second doors shown in an open position and a mullion assembly coupled to the first door.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Referring now to FIG. 1, reference numeral 2 general designates a bottom-mount refrigerator for use with the present concept. The refrigerator 2 includes a cabinet 4 having a top wall 6, a bottom wall 7, opposing sidewalls 8 and 9, and a rear wall 10 which cooperate to define first and second compartments 12 and 14. In the embodiment shown in FIG. 1, the first compartment 12 is disposed above the second compartment 14. As shown, the first compartment 12 includes a liner 15 having a top wall 16, a bottom wall 17, opposing sidewalls 18 and 19 and a rear wall 20. A first guide member 22 is shown disposed on a front portion of top wall 16 of the liner 15, and a second guide member 24 is shown disposed on a front portion of the bottom wall 17 of the liner 15. The first and second guide members 22, 24 define upper and lower guide members for guiding rotational movement of a mullion assembly as further described below.

Although not specifically identified, the refrigerator 2 includes a refrigeration system for providing above and below freezing temperatures in compartments 12 and 14, respectively. Thus, in the embodiment of FIG. 1, it is contemplated that the first compartment 12 is a fresh food storage compartment, while the second compartment 14 is a freezer compartment. It is further contemplated that the open space configuration of the first compartment 12 may include various shelves, drawers and bins for dividing the open space and for storing items to be refrigerated in a manner known in the art. In FIG. 1, the second compartment 14 is selectively accessed via a door 30, which may be a sliding drawer-style door, having a handle 31. Thus, the refrigerator 2 is a bottom mount refrigerator with lower freezer door 30 being adapted to slide in and out of the cabinet 4 to provide access to frozen items stored within second compartment 14.

As further shown in FIG. 1, the refrigerator 2 includes an upper door assembly 26 which, is shown in a French-style door configuration including first and second doors 28 and 29. The first and second doors 28 and 29 are provided with respective handles 32, 33 to enable a consumer to open the first and second doors 28, 29 to selectively provide access to the first compartment 12. Specifically, the first and second doors 28, 29 are pivotally coupled to the cabinet 4 at upper and lower hinge assemblies 35 and 36, 37 and 38, respectively. The first and second doors 28, 29 are adapted to seal against an open front face portion 40 of the cabinet 4 in an air-tight manner to prevent cold air from escaping the first compartment 12. Specifically, the first and second doors 28, 29 seal against the open front face 40 of the cabinet 4 via flexible gasket assemblies 42, 43, respectively, which may be elastomeric assemblies that may include sealing magnetic members disposed therein.

Except as otherwise identified below, the structure of each of the first and second doors 28, 29 is substantially identical, however, reversed in configuration as known in the art. Therefore, a detailed description of the basic structure of the first door 28 is herein provided and it is to be understood that the second door 29 has a reciprocal structure. As shown in FIG. 1, the first door 28 includes a door liner 50 having an outwardly projecting top portion 52, and outwardly projecting first and second side portions 54, 56 disposed on opposite sides of the top portion 52. A rear portion 58 interconnects the top portion 52 and the first and second side portions 54, 56 to collectively define a storage cavity 60. Within the storage cavity 60, it is contemplated that a variety of shelf members, i.e. adjustable shelves, bins, storage units and the like, can be positioned within the storage cavity 60 as supported between the opposing side portions 54, 56.

Figure 4A:
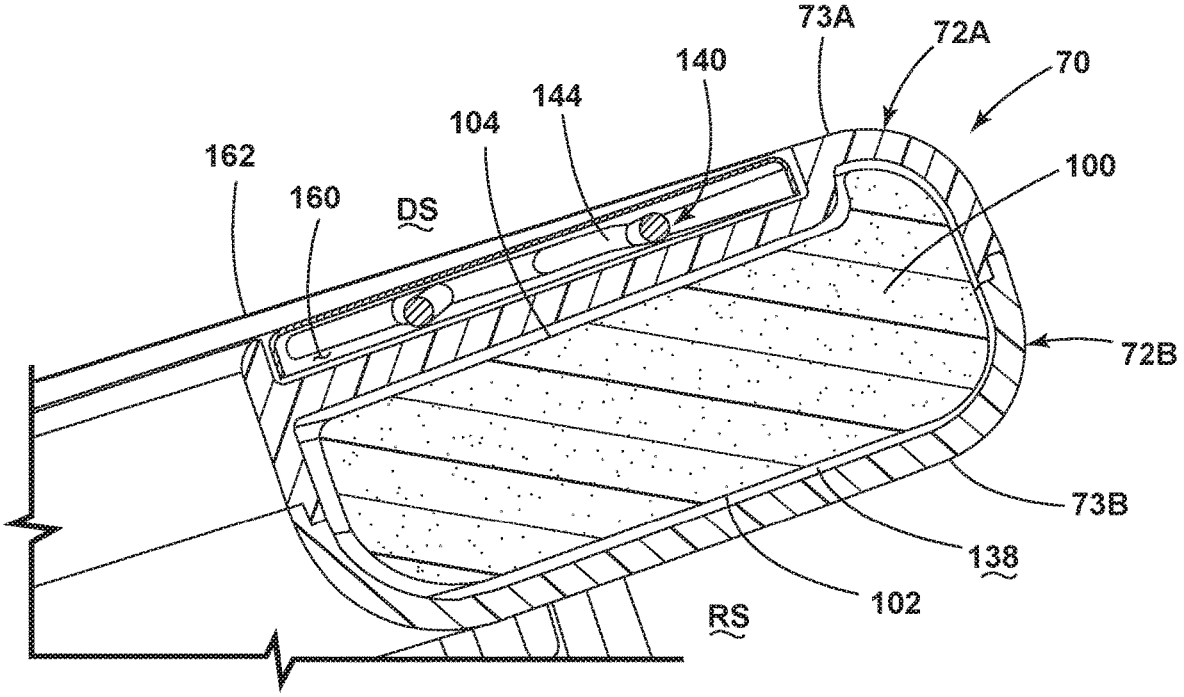
FIG. 4A is a cross-sectional view of the mullion assembly of FIG. 2 in an assembled condition.
Figure 4B:
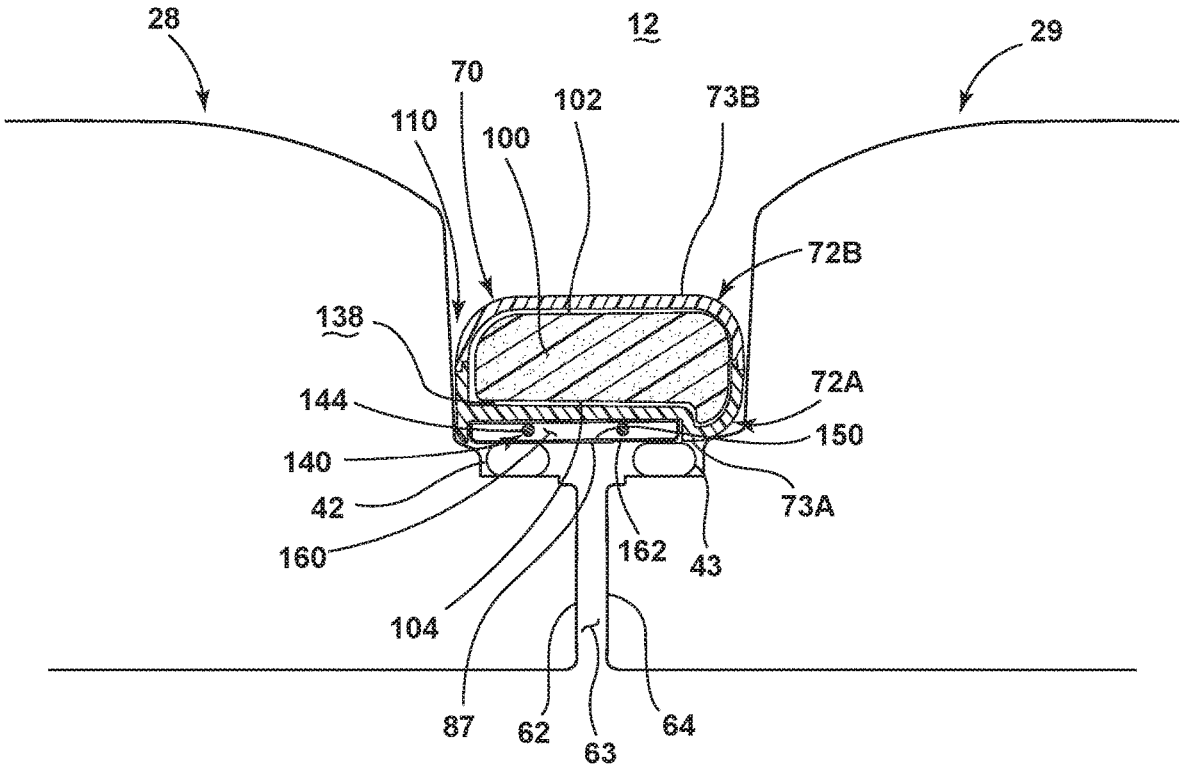
FIG. 4B is a cross-sectional view of the refrigerator of FIG. 3 taken along line IV.

As further shown in FIG. 1, the first and second doors include inside edges 62, 64, respectively, which are configured to seal against a mullion assembly 70 when the doors 28, 29 are in a closed position, as best shown in FIG. 4B. The mullion assembly 70 is shown in an inwardly rotated position, which is generally guided by the first and second guide members 22, 24 interacting with the mullion assembly 70 as the first door 28 moves to the open position. Thus, the mullion assembly 70 is pivotally coupled to the first door 28 for rotation between retracted and deployed positions, as further described below. While the mullion assembly 70 is shown coupled to the first door 28, it is also contemplated that the mullion assembly 70 can be mounted to the second door 29, such that the present concept is not to be limited to a specific right or left door mounting of the mullion assembly 70.

Figure 2:
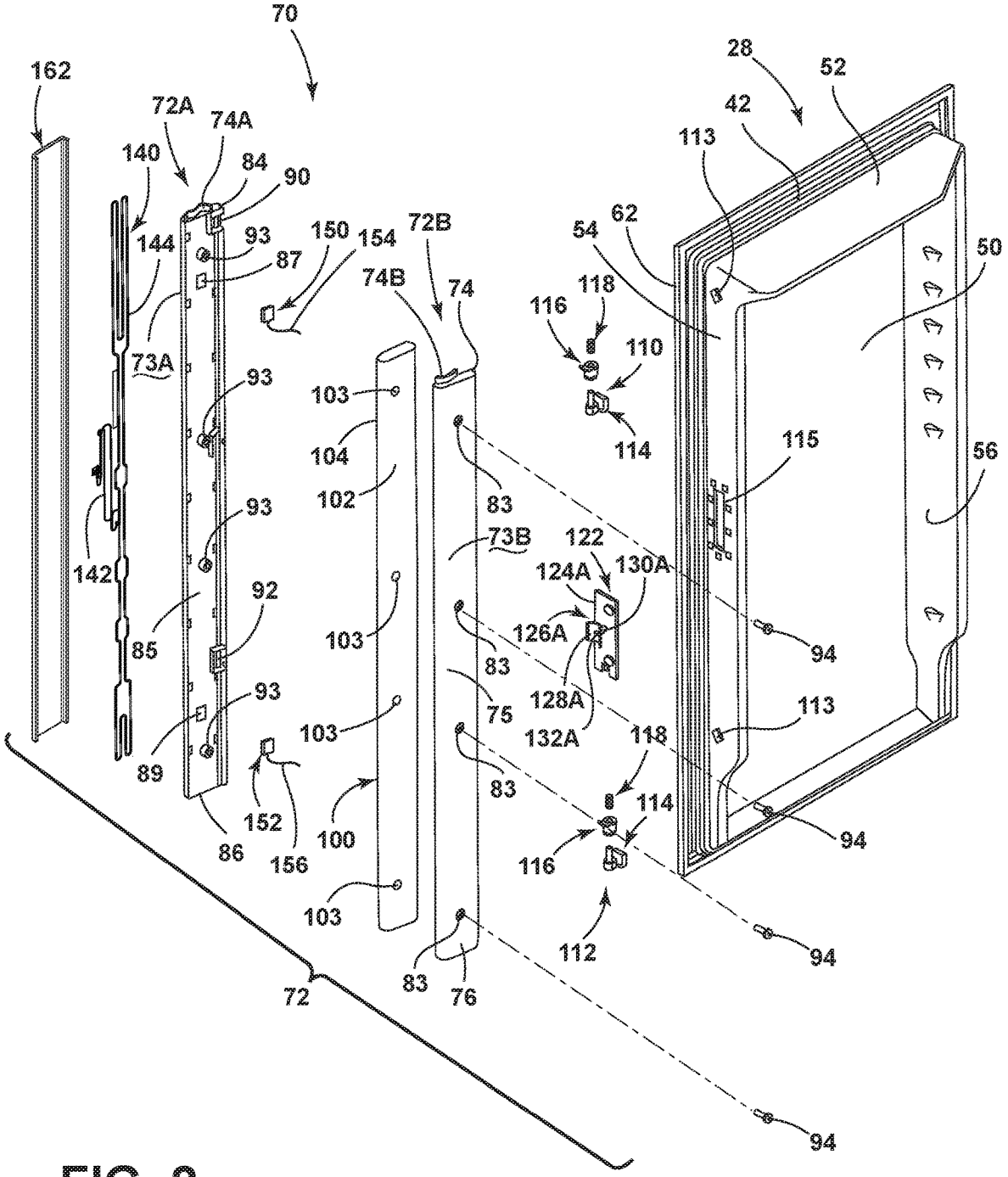
FIG. 2 is a top perspective view of the first door of FIG. 1 as removed from the refrigerator and an exploded perspective view of the mullion assembly.

Referring now to FIG. 2, the mullion assembly 70 is shown in an exploded view and includes a multi-part mullion bar 72 comprised of first and second cover members 72A, 72B, which are preferably comprised of molded plastic. As shown in the embodiment of FIG. 2, the second cover member 72B defines an inner portion of the mullion bar 72 and includes a first end 74, a second end 76, and an interconnecting transverse web portion 75 with an inner surface 73B. The first end 74 is provided with an outwardly extending guide pin 74B for use as further described below. The second cover member 72B further includes a plurality of mounting apertures 83 disposed through the transverse web portion 75. As used throughout this disclosure, the mullion assembly 70 and the mullion bar 72 may be described as being operable between retracted and deployed positions. The retracted and deployed positions of the mullion assembly 70 is meant to convey the pivoting movement of the mullion bar 72 as a main feature of the mullion assembly 70.

Figure 3:
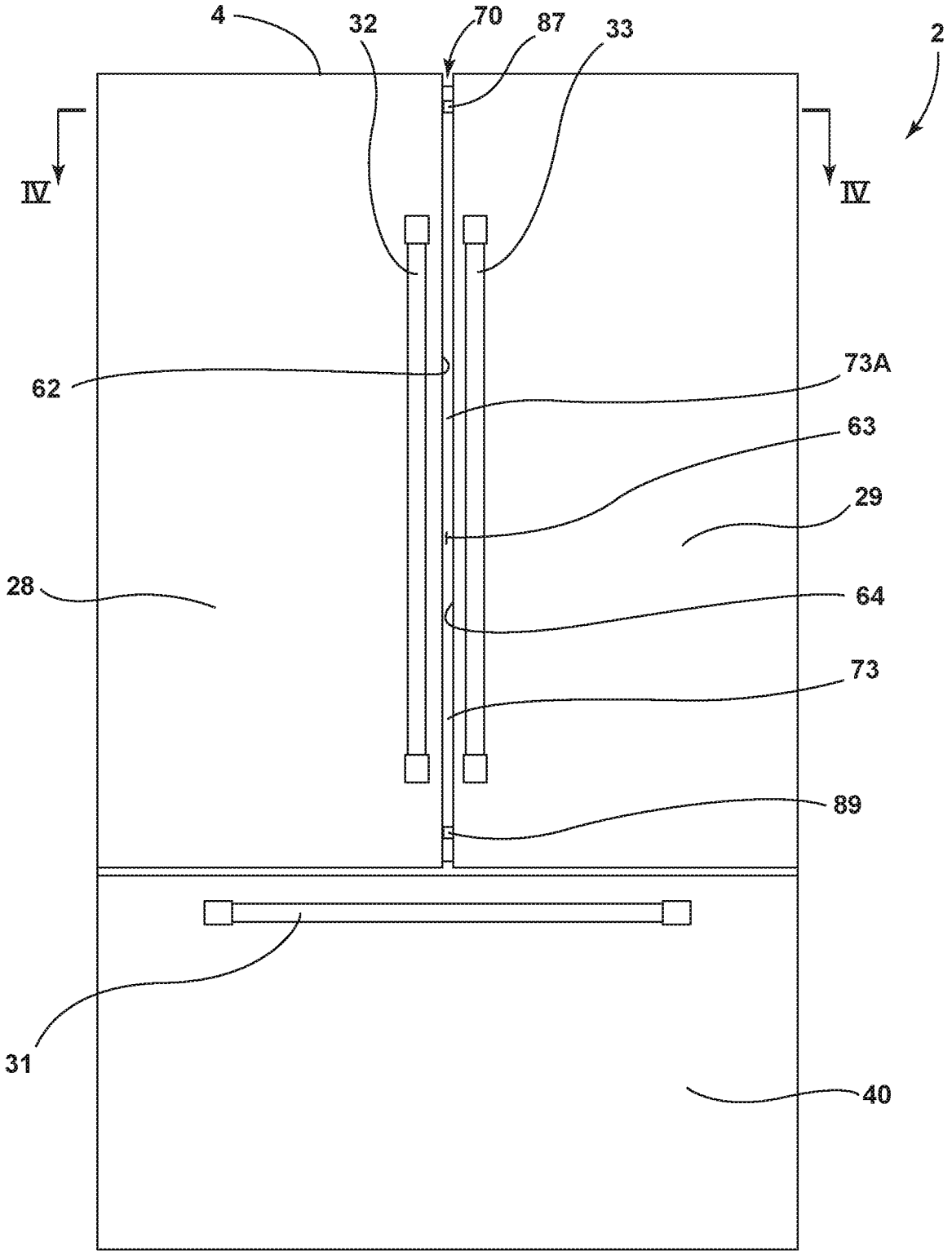
FIG. 3 is a front elevation view of the refrigerator of FIG. 1 with the first and second doors in a closed position.

As further shown in the embodiment of FIG. 2, the first cover member 72A defines an outer portion of the mullion bar 72 and includes a first end 84, a second end 86, and an interconnecting transverse web portion 85 having an outer surface 73A. As providing an outer portion of the mullion bar 72, the outer surface 73A of the first cover member 72A defines a sealing surface of the transverse web portion 85 for the gasket assemblies 42, 43 of the first and second doors 28, 29 to seal against when the first and second doors 28, 29 are closed and the mullion bar 72 is in the deployed position (FIG. 4B). The first end 84 of the first cover member 72A is provided with an outwardly extending guide pin portion 74A for use as further described below. The first cover member 72A further includes inner an inner edge 88 having a plurality of engagement members 90, 92 disposed thereal-ong. The first cover member 72A further includes a plurality of mounting bosses 93 disposed through the transverse web portion 85. As further shown in FIG. 2, upper and lower windows 87, 89 are disposed through the transverse web portion 85 of the first cover member 72A. The windows 87, 89 may include apertures disposed through the transverse web portion 85 of the first cover member 72A, or may comprise transparent or translucent polymeric members through which sensors can take accurate readings of the outside ambient conditions relative to the mullion assembly 70. The upper and lower windows 87, 89 are generally positioned within a central portion of the transverse web portion 85, such that the upper and lower windows 87, 89 can be positioned within a gap 63 disposed between the inside edges 62, 64 of the first and second doors 28, 29, as best shown in FIG. 3. In this way, the windows are configured to position sensors, further described below, and appropriate position on the mullion assembly 70 measuring ambient conditions, such as temperature and relative humidity.

In assembly, the first and second cover members 72A, 72B are configured to couple to one another to define a unitary mullion bar 72 having a cavity 138 (FIGS. 4A and 4B) disposed therebetween. The first and second cover members 72A, 72B couple to one another using fasteners 94 which are received through mounting apertures 83 of the second cover member 72B and threadingly engage mounting bosses 93 of the first cover member 72A. When the first and second cover members 72A, 72B are coupled to one another, the first and second ends 74, 84 and 76, 86 are aligned with one another. The outwardly extending guide pins portions 74A, 74B of the first and second cover members 72A, 72B also aligned to provide a unitary guide pin for engaging the guide member 22 disposed on the top wall 16 of the liner 15 shown in FIG. 1. The unitary guide pin engages the guide member 22 to induce rotational movement of the mullion bar 72 between the retracted position and the deployed position, in a manner as known in the art, when the first door 28 (to which the mullion bar 72 is hingedly coupled) is moved between open and closed positions. It is further contemplated that a lower guide pin assembly can be disposed on the second ends 86, 76 of the first and second cover members 72A, 72B, respectively for engage guide member 24 disposed on the bottom wall 17 of the liner 15 (FIG. 1) for further guiding rotational movement of the mullion assembly 70.

As further shown in FIG. 2, an insulating member 100 is configured to be received in a cavity 138 (FIGS. 4A and 4B) defined between the first and second cover members 72A, 72B when the first and second cover members 72A, 72B are coupled to one another. The insulating member 100 includes a plurality of receiving apertures 103 through which fasteners 94 are received through when coupling the first and second cover members 72A, 72B to one another. The insulating member 100 includes first and second sides 102, 104 which define inner and outer sides of the insulating member 100, respectively. The insulating member 100 may be a solid foam member, or a sprayed foam material that can be applied to the first and second cover members 72A, 72B, or directly into the cavity 138 formed therebetween. It is contemplated that the insulating member 100 may include a foam composition having a hydrofluoroolefin (HFO) component. As compared to expanded polystyrene (EPS) foam, a foam composition having an HFO blowing agent can provide a polyurethane foam material having better insulative properties to create a solid thermal barrier between the refrigerator compartment 12 in the ambient conditions of the refrigerator 2 at the mullion assembly 70.

In coupling the mullion bar 72 to the first door 28, a number of hinge assemblies, such as upper and lower hinge assemblies 110, 112, are used to interconnect the first door 28 to the mullion bar 72. While two hinge assemblies (110, 112) are shown in the embodiment of FIG. 2, it is contemplated that more or fewer hinge assemblies may be used to couple the mullion bar 72 to the first door 28 in a pivoting manner, without departing from the present concept.

As further shown in FIG. 2, the hinge assemblies 110, 112 define upper and lower hinge assemblies for pivotally coupling the mullion bar 72 to the first door 28. Specifically, the hinge assemblies 110, 112 are configured to mount the mullion bar 72 to the outwardly projecting first side portion 54 of the liner 50 of the first door 28 at dovetail connectors 113, such that the mullion bar 72 is pivotally mounted adjacent to the inside edge 62 of the first door 28. A pivot member 122 is shown disposed between the first and second hinge assemblies 110, 112. The pivot member 122 includes a cover plate 124 in an outwardly extending pivot feature 126A having a curved outer pivot surface 128A extending outwardly from the cover plate 124 by a sleeve 130A. The sleeve 130A opens through the cover plate 124 at access aperture 132A. In this way, the sleeve 130A can be used to provide access for a control wire to power electrical features of the mullion bar 72, such as sensors 150, 152 and a heating element 140 as further described below. In assembly, the pivot member 122 is mounted to an access aperture 115 disposed on the outwardly projecting first side 54 of the liner 50 of the first door 28.

As further shown in FIG. 2, the first and second hinge assemblies 110, 112 each include a first hinge element 114, a second hinge element 116, and a biasing mechanism 118 shown in the embodiment of FIG. 2 in the form of a coil spring. In use, the biasing mechanism 118 is configured to provide a biasing force to hold the second hinge element 116 against the first hinge element 114 as the second hinge element 116 rotates with the mullion bar 72, as coupled thereto. The first and second hinge assemblies 110, 112 are contemplated to be similar or identical in configuration, such that the description of the first hinge assembly 110 provided below with reference to FIG. 3 will also described the features of the second hinge assembly 112.

As further shown in FIG. 2, upper and lower sensor assemblies 150, 152 are shown and configured to align with the upper and lower windows 87, 89 of the first cover member 72A of the mullion assembly 70. The upper and lower sensor assemblies 150, 152 each include leads 154, 156, respectively, which are configured to be received through the sleeve 130A disposed through the cover plate 124 via access aperture 132A to connect to a power source of the refrigerator 2. The upper and lower sensor assemblies 150, 152 may include multiple sensors per assembly or may be dedicated sensors configured to sense ambient humidity, ambient temperature and other such values for calculating a dew point condition for the mullion assembly 70 and calculating a duty cycle for the heating element 140. The dew point is defined as atmospheric temperature (varying according to pressure and humidity) below which water droplets begin to condense and dew can form on the mullion assembly 70. Particularly, the mullion assembly 70 is susceptible to dew formation on the inner and outer surfaces 73B, 73A of the cover members 72B, 72A. The upper and lower sensor assemblies 150, 152, either alone or in combination, will calculate the dew point temperature by using the empirical formula: Td=Tamb−((100−RHamb)/5). In this formula, Td=the dew point temperature, Tamb=the ambient temperature and RHamb=ambient relative humidity. Thus, the upper and lower sensor assemblies 150, 152, either alone or in combination, must be configured to sense a current ambient relative humidity value along with an ambient temperature value. With these values, the dew point temperature (Td) can be calculated. It is contemplated that a controller may be used to calculate the dew point temperature (Td) using the values provided by the upper and lower sensor assemblies 150, 152.

As noted above, either the upper sensor assembly 150 or the lower sensor assembly 152 may include multiple sensors that can provide the values necessary for running a runtime algorithm for the heating element 140, such that only one sensor assembly may be required in the overall mullion assembly 70. It is contemplated that the present concept will also include a controller 158 (FIG. 1). The controller 158 is configured to receive data from the sensor assemblies 150, 152 for controlling power aspects of the heating element 140, such as runtime, duration, modulated power level, and the like. Using information from the sensor assemblies 150, 152, the controller 158 of the present concept is configured to provide a more efficiently run heating element 140 by varying the parameters of a power supply to the heating element 140 based on the information provided by the sensor assemblies 150, 152. The controller 158 may be hardwired to the sensor assemblies 150, 152, or may be electronically coupled with the sensor assemblies 150, 152 using a wireless connection. As used herein, the sensor assemblies 150, 152 may be described as monitoring, sensing, detecting and providing data regarding the mullion assembly. All such terms, and other like terms, are contemplated to indicate that the sensor assemblies 150, 152 are configured to gather data and send the same to the controller for processing.

The sensor assemblies 150, 152 may, either alone or in combination, include temperature sensors configured to provide temperature values for the ambient temperature from the environment in which the mullion assembly 70 is located. Such temperature sensing units may include thermistors or other like sensors. Such relative humidity sensing units may also include optical sensors configured to detect the presence of condensation. Use of the information provided by the sensor assemblies 150, 152 is further described below. Still further, the sensor assemblies 150, 152 may, either alone or in combination, include dew point sensing units configured to provide dew point temperature values for the environment in which the mullion assembly 70 is disposed. Such dew point sensing units may be configured to send dew point calculations to the controller for further processing in a power modulation cycle for the heating element 140.

As noted above, a heating element 140 is contemplated to be included in the overall structure of the mullion assembly 70 in an effort to combat the development of condensation. As shown in FIG. 2, the heating element 140 includes a lead 142 which, like leads 154, 156 of the upper and lower sensor assemblies 150, 152, may be configured to access a power source of the refrigerator 2 through the sleeve 130A disposed through the cover plate 124 via access aperture 132A. It is contemplated that the heating element 140 comprises a wire 144 disposed in a pattern, as shown in FIG. 2, that generally covers the entire length and width of the mullion assembly 70. The pattern of the wire 144 shown in FIG. 2 is only exemplary, and other patterns for the wire 144 are contemplated for use with the present concept. It is further contemplated that the heating element 140 may be a pulse width modulation (PWM) controlled element, as known in the art. As used in conjunction with the upper and lower sensor assemblies 150, 152, the PWM of the heating element 140 can be adjusted to effectively combat the development of dew/condensation on surfaces of the mullion assembly 70 in a more energy efficient manner, and in real time.

As further shown in FIG. 2, the heating element 140 may be disposed along the outer surface 73A of the first cover member 72A. A trim piece 162 is provided to enclose the heating element 140 within an inset portion 160 (FIGS. 4A and 4B) of the outer surface 73A of the first cover member 72A. The trim piece 162 is contemplated to be a metal plate member which can be used to magnetically engage gasket assemblies 42, 43 of the doors 28, 29, as further shown in FIG. 4B. It is contemplated that the windows 87, 89 of the first cover member 72A may be positioned on the trim piece 162 (as shown in FIG. 4B) to ensure that the sensor assemblies 150, 152 have uninhibited access to the ambient environment surrounding the refrigerator 2 to facilitate the gathering of specific values from the ambient conditions, such as ambient temperature and relative humidity.

With reference to FIG. 3, the refrigerator 2 is shown with the first and second doors 28, 29 in a closed position with the mullion assembly 70 in a deployed position. With the first and second doors 28, 29 in the closed position and the mullion assembly 70 in the deployed position, the mullion assembly 70 bridges the gap 63 between the inner edges 62, 64 of the first and second doors 28, 29. With the mullion assembly 70 in the deployed position between the closed doors 28, 29, the windows 87, 89 thereof are shown positioned within the gap 63, such that the windows 87, 89 are exposed to ambient conditions directly associated with the mullion assembly 70. It is further contemplated that the sensor assemblies 150, 152, and any associated windows, may be positioned on the top portion of the mullion assembly 70 or the bottom portion of the mullion assembly 70. For use with the present concept, it is noted that the sensor assemblies 150, 152 are directly associated with and incorporated into the structure of the mullion assembly 70 to gather real-time ambient conditions to which the mullion assembly 70 is directly exposed. As the present concept seeks to control condensation on the mullion assembly 70, it is important that the sensors of the sensor assemblies 150, 152 gather information directly associated with the mullion assembly 70. Thus, unlike other sensor placement on various positions of a refrigerator compartment known in the art, the sensor assemblies 150, 152 of the present concept are incorporated into the mullion assembly 70 for gathering information that is specific to the mullion assembly 70 and the environment in which the mullion assembly 70 is disposed. By providing real-time information regarding ambient temperature and relative humidity of the mullion assembly environment, calculations for running energy cycles for the heating element 140 of the mullion assembly 70 can be tailored to provide energy efficient run duty cycles that are intermittently run as opposed to constantly run duty cycles used in other known mullion assemblies.

As calculated, the dew point temperature (Td) will be compared with a temperature value of the mullion assembly 70 itself (Tma). Thus, the upper and lower sensor assemblies 150, 152 are contemplated to be configured to sense a temperature value of the mullion assembly 70 itself. Specifically, the temperature value (Tma) of the mullion assembly 70 may be a temperature of a particular surface of the mullion assembly 70 where condensation is likely to form, such as outer surface 73A of first cover member 72A or the trim piece 162. Thus, as shown in FIG. 2, the upper and lower sensor assemblies 150, 152 are positioned at upper and lower portions 84, 86 of the first cover member 72A which tend to be colder portions of the cover member 72A where condensation is likely to form. Other locations for the upper and lower sensor assemblies 150, 152 are also contemplated for use with the present concept. When the outer surface 73A, or any other surface of the mullion assembly 70, has a temperature value that is equal to or lower than the dew point temperature of the ambient air, condensation is likely to form on that surface. Depending on how close the temperature (Tma) of the outer surface 73A of the mullion assembly 70 is to the dew point temperature (Td), and also depending on the trend of the Tma (whether increasing or decreasing), the PWM of the heating element 140 will be adjusted.

Generally, the controller 158 will initiate a heating sequence for the heating element 140 as the temperature Tma of the mullion assembly 70 approaches the dew point temperature Td to keep moisture from developing on surfaces of the mullion assembly 70. However, if a temperature Tma of the mullion assembly 70 below the dew point temperature Td is detected, the controller 158 is configured to provide full power to the heating element 140 to combat any condensation effects. For example, if the Tma is 3° C. below the dew point temperature (Td), then the controller 158 can initiate a heating sequence for the heating element 140 of the mullion assembly 70 at a first modulated power level which may include 100% PWM to the heating element 140. With the heating element 140 of the mullion assembly 70 activated, the temperature of the mullion assembly Tma will increase, such that a value differential (VD) calculated as the difference between Tma and Td (Tma-Td) will start increasing as well. As the difference between Tma and Td rises from −3° C. goes to −2° C., the controller 158 can lower the PWM to the heating element 140 to a second modulated power level that is less than the first modulated power level as an energy conservation measure. The second modulated power level may be 75% PWM for example. As the value differential (VD) between Tma and Td rises from −2° C. goes to −1° C., the controller 158 can again lower the PWM to the heating element 140 to a third modulated power level that is less than the second modulated power level. Such a third modulated power level may include 60% PWM to the heating element 140. This trend can continue as the Tma approaches and passes the dew point temperature Td when a heating sequence to the heating element 140 can be terminated. In this way, the value differential (VD) between the Tma and Td is inversely proportional to the modulated power level provided to the heating element 140. Said another way, as the value differential (VD) increases, the power to the heating element 140 is lessened to provide an energy savings in heating the mullion assembly 70. Thus, the PWM to the heating element 140 continuously adjusts depending on the power requirements and keeps the Tma above the dew point temperature Td in a more efficient way as compared to heating elements that turn on at full power and remain at full power for an entire heating sequence, or as compared to heating elements that are constantly run at a continuous level 24 hours a day.

Using the HFO foam material described above for the insulating member 100, an energy benefit is realized with regards to the amount of energy required to run the heating element 140. Specifically, the power requirements for running the heating element 140 may drop from 10 W to 7 W when comparing a mullion assembly using an EPS foam material with a mullion assembly using an HFO foam material of the present concept. Specifically, by using an HFO insulating member 100 in the mullion assembly 70 instead of an EPS foam member, it was observed that due to better insulation by the HFO insulating member 100 of the inner surface 73B of the mullion assembly 70 disposed adjacent to the refrigerator compartment 12, no condensation was observed on the trim member 162 and outer surface 73A at room conditions of 85% RH and 90° F. No condensation was realized even when reducing the wattage of the heating element 140 from 10 W to 7 W. When testing with an EPS foam member was conducted, condensation was observed on trim member 162 and outer surface 73A of the mullion assembly 70 even at 9 W power. Thus, by using an HFO insulating member 100 in the mullion assembly 70 instead of an EPS foam member, power required to run the heating element 140 was reduced from 10 W to 7 W. This reduction in power results in about a 4% benefit in energy consumption.

As noted above, the controller 158 is configured to provide a run cycle algorithm that makes the mullion assembly 70 operate at an average of 33% PWM during an energy cycle. As such, the power consumption of the heating element 140 was tested to be 25% of the total wattage (7 W), which is 1.75 W, when run at a standard ambient testing condition of 60% RH at 25° C. or 77° F. So, for a 24 hr. energy cycle, the energy consumption for the heating element 140 was tested to be (0.25*0.007*24) which is equal to 0.042 KWhrs/day. Using a constant energy cycle of the known algorithms of the art, the power consumption would be 60% flat of the total wattage (7 W). This equates to 4.2 W. So, for a 24 hr. Energy cycle using an old algorithm, the total energy consumption would be (0.6*0.007*24) 0.1008 KWhrs/day. Thus, by using current conditions of the mullion assembly 70 to optimize the operation of the heating element 140 via the controller 158, the energy benefit over a period of 1 day was (0.1008-0.042) which is equal to 0.0588 KWhrs/day. Considering the total energy consumption of a mullion assembly without the algorithm of the present concept to be 1.7 KWhrs/day, and a total consumption of the mullion assembly 70 with the present algorithm to be 1.641 KWhrs/day, an approximately 3% energy savings is realized.

Referring now to FIG. 4A, a cross-sectional view of the mullion assembly 70 is shown as assembled. In FIG. 4A, the mullion assembly 70 is shown having the cavity 138 thereof defined between the first and second cover members 72A, 72B. The insulating member 100 is shown disposed within the cavity 138 of the mullion assembly 70. The first side 102 of the insulating member 100 is shown disposed adjacent to the second cover member 72B and the inner surface 73B thereof. As further shown in FIG. 4A, the inner surface 73B of the second cover member 72B is disposed adjacent to a refrigerator side RS of the mullion assembly 70 when the mullion assembly 70 is in the deployed position. The second side 104 of the insulating member 100 is shown disposed adjacent to the first cover member 72A and the outer surface 73A thereof. As further shown in FIG. 4A, the outer surface 73A and the inset portion 160 of the first cover member 72A are disposed adjacent to a door side DS of the mullion assembly 70 when the mullion assembly 70 is in the deployed position. As such, the heating element 140 is shown disposed within the inset portion 160 of the first cover member 72A and covered by the trim piece 162 which is operably coupled to the first cover member 72A at the inset portion 160 thereof.

Referring now to FIG. 4B, the mullion assembly 70 is shown in a deployed position and seal against the first and second doors 28, 29 at first and second gasket assemblies 42, 43 which extend outwardly from the inner edges 62, 64 of the first and second doors 28, 29, respectively, and abut the trim piece 162 of the mullion assembly 70. As further shown in FIG. 4B, a first sensor assembly 150 is shown disposed adjacent to a window 87 of the trim piece 162 such that the window 87 and the first sensor assembly 150 are aligned with a gap 63 disposed between the first and second doors 28, 29. The placement of the sensor assemblies 150, 152 within or directly coupled to the mullion assembly 70 allows for ambient air and relative humidity values to be detected by the sensor assemblies 150, 152 that are directly associated with the mullion assembly as opposed to some other location on the refrigerator 2. With these directly associated values, a modulated power level and duty cycle for the heating element 140 can be calculated by the controller 158 (FIG. 1). As noted above, the sensor assemblies 150, 152 may be positioned anywhere along the mullion assembly 70 so long as the sensor assemblies 150, 152 are able to provide real-time information related to ambient air temperature, relative humidity, and actual temperature of a surface of the mullion assembly 70 to the controller 158. It is contemplated that the sensor assemblies 150, 152 may be configured to sense or detect an actual temperature of the outer surface 73A of the mullion assembly 70. The trim piece 162 may be defined as the outer surface of the mullion assembly 70 as visible condensation is likely to form on this exposed portion of the mullion assembly 70. As such, the heating element 140 is disposed adjacent to the trim piece 162, such that the temperature of the trim piece 162 can quickly rise above a calculated dew point temperature during a duty cycle of the heating element 140. Further, it is contemplated that the trim piece 162 may be a metal member that is highly conductive for efficiently conducting heat provided by the heating element 140.

Further, a method of controlling condensation on a mullion assembly, is disclosed using the mullion assembly 70 and the components associated therewith. In one embodiment, the method includes the steps of: 1) providing a refrigerator 2 with a mullion assembly 70, wherein the mullion assembly 70 includes one or more sensors 150, 152 and a heating element 140; 2) collecting data in the form of a temperature value (Tma) of the mullion assembly 70, an ambient air temperature value (Tamb) associated with the mullion assembly 70, and a relative humidity (RHamb) value associated with the mullion assembly 70 using the one or more sensors 150, 152 of the mullion assembly 70; 3) sending the data to a controller 158 for processing; 4) calculating a dew point temperature value (Td) from the data using the controller 158; 5) comparing the dew point temperature value (td) with the temperature value of the mullion assembly (Tma) to provide a value differential (VD) therebetween using the controller 158; and 6) selectively powering the heating element 140 in response to the value differential (VD). As noted above, the temperature value Tma of the mullion assembly 70 may be specifically related to a temperature value of a particular surface of the mullion assembly 70, such as the outer surface 73A of the mullion assembly 70 or the trim piece 162 coupled thereto. Thus, it is advantages to have the heating element 140 of the mullion assembly 70 positioned adjacent to the outer surface 73A or trim piece 162 of the mullion assembly 70 where condensation is likely to occur, as shown in FIGS. 4A and 4B. As noted above, the step of comparing the dew point temperature value Td with the temperature value Tma of the mullion assembly 70 includes subtracting the dew point temperature value Td from the temperature value Tma of the mullion assembly 70 to provide the value differential (VD).

With regards to powering the heating element 140, the controller 158 may be configured to modulate an output from a power source, such as a power source provided by the refrigerator 2 or a receptacle to which the refrigerator 2 is connected, to provide power at a first modulated power level to the heating element 140. The method further includes the step of monitoring the value differential (VD) after the heating element 140 has been activated at any one modulated power level. The method further includes the step of modulating the output from the power source to provide power at a second modulated power level to the heating element 140 as the value differential (VD) increases. The second modulated power level is contemplated to be less than the first modulated power level by an amount proportionate to the difference in the value differential (VD) taken at the time of initiating the first modulated power level and the value differential (VD) taken at the time of initiating the second modulated power level. It is further contemplated the present method includes the step of deactivating the heating element 140 when the value differential (VD) reaches a threshold value or the temperature value Tma of the mullion assembly 70 reaches a threshold temperature. The threshold values and threshold temperatures can be stored values retained by and preprogrammed into the controller 158.

As noted above, the modulate power level of provided to the heating element 140 is the product of an algorithm calculated by the controller 158 using the data provided by the sensor assemblies 150, 152. Data from the sensor assemblies 150, 152 may be wirelessly communicated to the controller 158. Calculation of the dew point temperature Td is provided by the following equation Td=Tamb−((100-RHamb)/5). In this formula, Td=the dew point temperature, Tamb=the ambient temperature and RHamb=ambient relative humidity. The value differential VD is determined by the equation VD=Tma−Td. The controller will then selectively power the heating element 140 at a modulated power level that is inversely proportionate to the value differential VD from a beginning to an end of a duty cycle. The duty cycle may be calculated for a set period of time as determined by the controller. During any given duty cycle, the modulated power level will be greater than a modulated power level provided at the end of the duty cycle. It is further contemplated that the sensor assemblies 150, 152 are constantly monitoring the various conditions of the mullion assembly 70 and updating the controller 158 with real-time information, such that the controller 158 can act at any time to activate or deactivate the heating element 140 as necessary to combat dew formation on the mullion assembly 70.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connectors or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above are merely for illustrative purposes and not intended to limit the scope of the device, which is defined by the following claims as interpreted according to the principles of patent law, including the Doctrine of Equivalents.

What is claimed is:

1. A refrigerator, comprising:

a storage compartment having an open front portion;

first and second doors operable between open and closed positions with respect to the open front portion of the storage compartment;

a mullion assembly pivotally coupled to one of the first and second doors and operable between retracted and deployed positions, wherein the mullion assembly includes first and second cover members coupled to one another to define a cavity therebetween, and further wherein the mullion assembly bridges a gap defined between inner edges of the first and second doors when the mullion assembly is in the deployed position and the first and second doors are in the closed position, and further wherein the first cover member includes upper and lower windows disposed through first cover member, wherein the upper and lower windows are aligned within the gap defined between inner edges of the first and second doors;

an insulating member positioned within the cavity of the mullion assembly;

an upper sensor assembly coupled to the mullion assembly and aligned with the upper window;

a lower sensor assembly coupled to the mullion assembly and aligned with the lower window below the upper sensor assembly; and a heating element coupled to the mullion assembly.

2. The refrigerator of claim 1, wherein the first cover member includes an inset portion on an outer surface thereof.

3. The refrigerator of claim 2, wherein the heating element is positioned in the inset portion of the first cover member.

4. The refrigerator of claim 3, including:

a trim piece coupled to the first cover member and covering the heating element.

5. The refrigerator of claim 1, wherein the upper and lower sensor assemblies include one of a dew point sensing unit configured to monitor ambient air temperature and ambient relative humidity, and a temperature sensing unit configured to monitor a temperature of the mullion assembly.

6. The refrigerator of claim 1, wherein the insulating member includes a foam member having a hydrofluoroolefin component.

* * * * *